US010030822B2

(12) United States Patent
Lin et al.

(10) Patent No.: US 10,030,822 B2
(45) Date of Patent: Jul. 24, 2018

(54) SOLAR SPECTRUM TYPE LED EYE-PROTECTION FLAT LAMP

(71) Applicants: Jinan Lin, Quanzhou (CN); Jinbiao Lin, Quanzhou (CN)

(72) Inventors: Jinan Lin, Quanzhou (CN); Jinbiao Lin, Quanzhou (CN)

( * ) Notice: Subject to any disclaimer, the term of this patent is extended or adjusted under 35 U.S.C. 154(b) by 305 days.

(21) Appl. No.: 14/759,414

(22) PCT Filed: Jan. 7, 2013

(86) PCT No.: PCT/CN2013/000013

§ 371 (c)(1),
(2) Date: Jul. 21, 2015

(87) PCT Pub. No.: WO2014/106307

PCT Pub. Date: Jul. 10, 2014

(65) Prior Publication Data

US 2015/0338033 A1 Nov. 26, 2015

(51) Int. Cl.
*F21V 7/00* (2006.01)
*H05B 35/00* (2006.01)
(Continued)

(52) U.S. Cl.
CPC ..... *F21K 9/54* (2013.01); *F21V 7/0025* (2013.01); *F21V 13/04* (2013.01); *F21V 23/004* (2013.01); *F21V 29/70* (2015.01); *F21V 29/89* (2015.01); *F21V 5/002* (2013.01); *F21Y 2113/13* (2016.08); *F21Y 2115/10* (2016.08)

(58) Field of Classification Search
CPC ..... F21V 23/004; F21V 29/70; F21V 29/89; F21V 7/0025; F21V 13/04; F21V 5/002; F21V 1/00; F21V 7/0008; F21V 7/0058; F21Y 2113/13; F21Y 2103/33;
(Continued)

(56) References Cited

U.S. PATENT DOCUMENTS 7,891,840 B1 * 2/2011 Kang ..... F21K 9/00 362/249.02
2003/0189831 A1 * 10/2003 Yoneda ..... F21K 9/00 362/294
(Continued)

FOREIGN PATENT DOCUMENTS

CN 201428983 Y 3/2010
CN 201875489 U 6/2011
(Continued)

*Primary Examiner* — Erin Kryukova
(74) *Attorney, Agent, or Firm* — Gokalp Bayramoglu

(57) ABSTRACT

Disclosed is a solar spectrum type LED type eye-protection flat lamp, comprising: a front diffusion panel, a front grating panel, a circuit board, a rear reflection and diffusion panel, a multicolor LED lamp bead group and an annular reflector. The front grating panel is snugly attached to the front diffusion panel and is arranged on a concave disk at the light-emitting side of the LED eye-protection flat lamp, and the front diffusion panel is arranged in front of the front grating panel; the rear reflection and diffusion panel is snugly attached to the circuit board and is arranged on a back-side concave disk of the LED eye-protection flat lamp, and the reflection and diffusion panel is arranged in front of the circuit board.

3 Claims, 1 Drawing Sheet

(51) Int. Cl.

| | |
|---|---|
| ***F21V 1/00*** | (2006.01) |
| ***F21V 11/00*** | (2015.01) |
| ***F21K 99/00*** | (2016.01) |
| ***F21V 23/00*** | (2015.01) |
| ***F21V 29/89*** | (2015.01) |
| ***F21V 29/70*** | (2015.01) |
| ***F21V 13/04*** | (2006.01) |
| *F21V 5/00* | (2018.01) |
| *F21Y 115/10* | (2016.01) |
| *F21Y 113/13* | (2016.01) |

(58) Field of Classification Search
CPC . F21Y 2115/10; G02B 5/1814; G02B 6/0096; G02F 2001/133618; G02F 2001/133624
USPC ..... 362/615
See application file for complete search history.

(56) References Cited

U.S. PATENT DOCUMENTS

2007/0263393 A1* 11/2007 Van De Ven ..... F21V 29/2212 362/362
2008/0062424 A1* 3/2008 Shires ..... F21K 9/00 356/446
2009/0141468 A1* 6/2009 Yang ..... F21V 19/0025 361/807
2010/0001648 A1* 1/2010 De Clercq ..... H05B 33/0821 315/113
2010/0046200 A1* 2/2010 Kuo ..... G02B 5/0252 362/97.1
2010/0219760 A1* 9/2010 Tanaka ..... F21V 5/04 315/152
2011/0002124 A1* 1/2011 Chang ..... F21V 19/001 362/294
2012/0081903 A1* 4/2012 Leung ..... F21V 7/0058 362/294
2012/0106198 A1* 5/2012 Lin ..... G02B 6/0083 362/609
2013/0301240 A1* 11/2013 Liu ..... F21V 13/04 362/97.1
2013/0322069 A1* 12/2013 Liao ..... F21S 8/02 362/235

FOREIGN PATENT DOCUMENTS

CN 201875489 U 7/2011
CN 202091913 U 12/2011
JP 201108520 A 6/2011

* cited by examiner

SOLAR SPECTRUM TYPE LED EYE-PROTECTION FLAT LAMP

TECHNICAL FIELD

This invention relates to the technology field of indoor illumination, more particularly, it relates to a solar spectrum type LED eye-protection flat lamp.

BACKGROUND OF THE INVENTION

Recently, the market competitiveness for both tube type and bulb type LED lighting fixtures for indoor illumination is limited due to the problems of high directivity, glare, difficulty of heat dissipation due to the close arrangement of LED lamps, heavy weight of the heat dissipation plate, and the high cost of designing. These problems are also an obstacle for the wide use of both tube and bulb LED lighting fixtures for indoor lighting. Current LED flat lamps, which are based on LCD Backlight Techniques, basically solves the problems of high directivity and glare, however still fails to consider the requirements of a Color Rendering Index, light extraction efficiency, and manufacturing cost, especially with regards to the Color Rendering Index of the eye-protection reading lamp, which can hardly meet or approximate the requirement of a standard light source (solar spectrum type).

Said LED flat lamp, based on LCD Backlight Techniques, includes a LED light strip, an aluminum frame, a Light Guide Plate and an aluminum heat conducting plate. Since the LED light strip is disposed on the aluminum profile frame, which has good heat dissipating performance, the light emitted from the LED light strip can be refracted and reflected by the Light Guide Plate to output uniform and soft light proximate to natural light. By increasing the heat dissipation area, the aluminum heat conducting plate enables heat to go through the flowing air in order to dissipate the heat completely. The Light Guide Plate is made of optical material using silk printing dots or etching dots, in order to uniformly diffuse the light emitted from the LED by refracting and reflecting in order to output the soft lighting on the whole surface.

In said LED flat lamp based on LCD Backlight Techniques, the light emitted from the LED light strip will come out from the scatterer of the silk printing dots or etching dots on the surface after multiple reflections in the Light Guide Plate. The light extraction efficiency of the LED plat lamp will decrease due to the multiple couples and reflection loss. Said aluminum profile frame and aluminum heat conduction plate will increase the manufacture cost while increasing the heat dissipation area. Furthermore, material used in said Light Guide Plate is expensive and manufacturing said Light Guide Plate will cost a lot; most importantly, when said LED plat lamp based on LCD Backlight Techniques is used for reading, the Color Rendering Index of said LED plat lamp cannot reach or approximate the requirement of a standard light source (solar spectrum type), and as a result fails to protect the eyes.

SUMMARY OF THE INVENTION

The objective of this invention is to provide a spectrum complementation solar spectrum type LED eye-protection flat lamp, which is different from the current light guide plate type white light LED plat lamp. This invention adopts a solution with multiple colors LED spectrum complementation, which overcomes disadvantages such as the large lack of spectrum and low value of color rendering index of the traditional white light LED lighting fixture. Moreover, this invention is designed without the light guide plate, solves the problems of low light extraction efficiency and high manufacture cost existed in the current white light LED plat lamp. This invention has the advantages of being simple, portable, and reliable in structure, low in cost, and having a color rendering index reach or approximate to 100 of a standard light source, etc. Since the emission spectrum approximates to the solar visible spectrum, which will be as soft as the natural light of the daytime, the function of eye-protection can be reached.

In order to reach the above objective, this invention provides the following solutions, A spectrum complementation solar spectrum type LED eye-protection flat lamp comprising: a front optical grating panel, a front diffusion panel, a circuit board, a rear reflection and diffusion panel, a multicolor LED lamp bead group, and an annular reflector; said front grating panel is closely attached to the front diffusion panel and is fixed on a concave disk at the light-emitting side of the LED eye-protection flat lamp, and the front diffusion panel is arranged in front of the front grating panel; said rear reflection and diffusion panel is closely attached to the circuit board, and then together installed on the inner bottom surface of the concave disk, wherein the reflection and diffusion panel is arranged in front of the circuit board; a distance is reserved between the front grating panel and the rear reflection and diffusion panel to form a gap; the multicolor LED lamp bead group is arranged around the circuit board, with LED lamp beads being located in said gap; and the annular, reflector is arranged around the inside of the concave disk of the LED eye-protection flat lamp.

Said front grating panel is a polymer film surface-relief two dimension grating, the angles between three groups of grating lines are 120°, and the grating spacing ranges from 50 μm to 100 μm.

Said circuit board comprises heat conducting copper, which can be directly used to dissipate heat without a heat dissipation plate.

Said multicolor LED lamp bead group adopts a combination, having a plurality of spectrum complementation multicolor LED lamp beads, comprising: white light LED, warm white light LED, red light LED, orange light LED, yellow light LED, and green light LED.

Said multicolor LED lamp beads are arranged in a single row or multi-row structure, wherein the warm white light LED, red light LED, orange light LED, yellow light LED and green light LED are arranged by the means of Combination and Permutation.

Said multicolor LED lamp bead group is aslant welded around the circuit board, wherein the angle between the LED lamp bead and the circuit board is in the range from 10° to 30°.

The output spectrum of said LED eye-protection flat lamp is basically equal to the visible part of the solar spectrum, and the color rendering index approximates to 100.

Said rear reflection and diffusion panel includes a plurality of regular or irregular protuberances located on the whole reflection surface.

The gap located between said front grating panel and the rear reflection and diffusion panel is in a range of 10 mm to 15 mm.

When said solar spectrum type LED eye-protection flat lamp works, said multicolor LED lamp bead group emits lights from the border to the front grating panel and front diffusion panel, the white light emitted from the white LED lamp beads and the complement light emitted from the warm white light LED, red light LED, orange light LED, yellow light LED and green light LED, will be diffracted by the front grating panel and diffused by the front diffusion panel to form uniform beams, having the spectrum approximating to the solar visible spectrum, emitted from the front of the flat lamp. Stray light, diffused to the rear panel, is reflected to the front panel via the reflection and diffusion panel. Other stray light, diffused to the border, is reflected to the front and rear panels by said annular reflector.

Therefore, comparing with prior arts: the emission spectrum of solar spectrum type LED eye-protection flat lamp of this invention, is basically the same as the solar visible spectrum, and the color rendering index can reach or approximate 100. However, the current white light LED flat lamp has the problem of a large lack of spectrum, and the color rendering index is about 80. At the same time, comparing with prior arts, this invention without a light guide plate, an aluminum substrate or a cooling plate therein, has the advantages of being simple in structure, portable, reliable, and low in cost. Especially, because the emission spectrum approximates the natural light, namely has a solar spectrum type lighting effect, which is good for eye-protection. This spectrum complementation solar spectrum type LED eye-protection flat lamp can be widely used in office buildings, classrooms, libraries, living rooms and so on.

DRAWINGS OF THE INVENTION

DETAILED DESCRIPTION OF THE INVENTION

Hereinafter, this invention will be clarified via specific embodiments.

Figure 1:
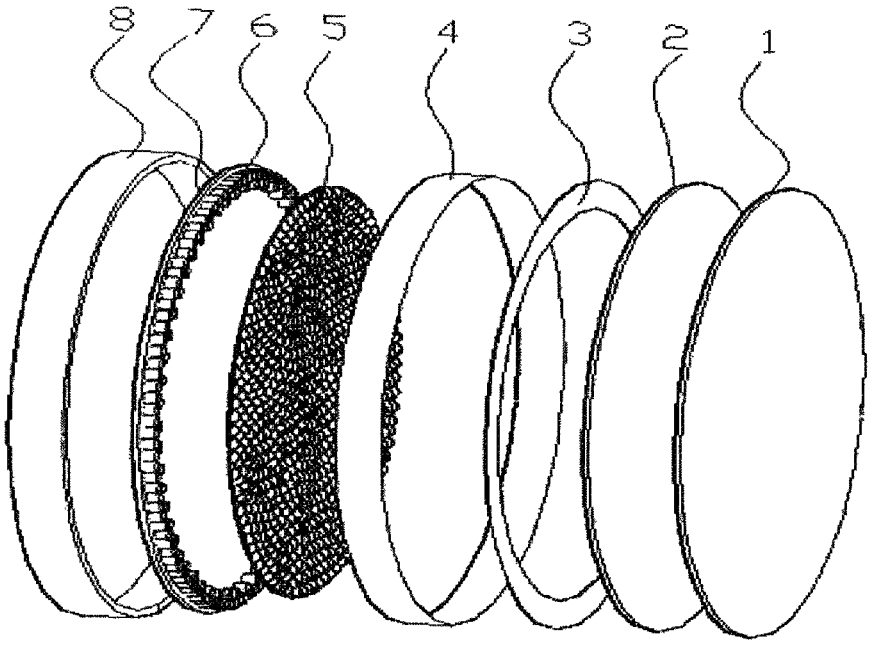
FIG. 1 is a schematic diagram of the structure decomposition of the preferred embodiment.

FIG. 1 is a schematic diagram of the structure decomposition of the preferred embodiment of a disk-shaped flat illuminant using a solar spectrum type LED eye-protection flat lamp. The disk-shaped flat illuminant comprises front diffusion panel 1, front grating panel 2, shading reflection ring 3 for the front panels, lateral ring reflector 4, rear reflection and diffusion panel 5, multicolor LED lamp bead group 6, circuit board 7 and concave disk 8, wherein:

Said front diffusion panel 1 is made of an Acrylic/organic glass panel with a matte and cloudy surface, wherein the preferred thickness is within the range of 1 mm to 2 mm, and the preferred diameter is within the range of 200 mm to 300 mm. Said front diffusion panel 1 is closely attached on concavity of the concave disk 8, and the matte and cloudy surface face toward the outside of the disk. Said front diffusion panel 1 is used to eliminate glare and simulate natural light, thereby making the visual effect of the emitted light more soft and comfortable.

Said front grating panel 2 is a polymer grating thin film having a thickness range of 0.1 to 0.3 mm, and a diameter that is the same as the diameter of Said front diffusion panel 1. The grating structure of said front grating panel 2 is a two-dimensional hexagonal structure. Angles between three groups of grating lines are 120°, and the preferred grating spacing ranges from 50 μm to 100 μm. Front grating panel 2 is closely attached to the inner surface of said front diffusion panel 1. The grating concave-convex surface of said front grating panel 1 faces to the front of diffusion panel 1, and is used to diffract the incident LED light emitted from the lateral side to the front of said front diffusion panel 1.

Said shading reflection ring 3 is an annular reflective thin film, which is closely attached to the inner surface of front grating panel 2. The outer diameter of said shading reflection ring 3 is the same as the outer diameter of front grating panel 2. The preferable width of said shading reflection ring 3 is just right to shade the LED lamp beads.

Said lateral annular reflector 4 is a ring reflector, wherein the diameter of the ring is smaller than said front diffusion panel 1, the width of the ring is the same as the gap spacing between said rear reflection and diffusion panel 5 and said front grating panel 2, which is within the range of 10 mm to 15 mm; the ring reflector 4 is embedded in the inner surface of concave disk 8.

Said rear reflection and diffusion panel 5 can be made by compressing reflective film, or by injecting and molding plastic substrates with metal reflective film coated thereon, the diameter of said rear reflection and diffusion panel 5 is 20 mm smaller than the diameter of said front diffusion panel 1; the surface of rear reflection and diffusion panel 5 is covered with a plurality of regular or irregular protuberances, the preferred diameter of the protuberances is within the range of 1 mm to 3 mm, a preferred height of the protuberances is within the range of 0.5 mm to 1.5 mm.

Said multicolor LED lamp beads group 6, having a combination of a plurality of spectrum complementation multicolor LED lamp beads, comprises white light LED, warm white light LED, red light LED, orange light LED, yellow light LED, and green light LED. Based on this, the emission spectrum of this invention is basically the same as the solar visible spectrum, and the color rendering index approximates 100.

Figure 2:
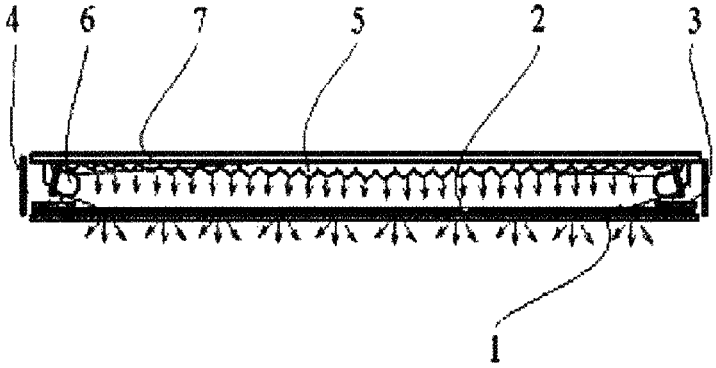
FIG. 2 shows the working principle of the preferred embodiment.

Said circuit board 7 has a copper coated surface, the diameter of circuit board 7 is slightly smaller than the diameter of front diffusion panel 1, and the preferred thickness of circuit board 7 is within the range of 1.5 mm to 2 mm. A large area of heat conducting copper is designed on the coating copper of circuit board 7 for heat dissipation. Said multicolor LED lamp bead group 6 is arranged on a circumference of the non-copper surface of said circuit board 7, the multicolor LED lamp bead group 6 is closely arranged in an annular double-row structure. The white light LED lamp beads are disposed on the outer row, and the lamp beads of warm white light LED, red light LED, orange light LED, yellow light LED, and green light LED are periodically arranged in such an order on the inner row. Referring to FIG. 2, said multicolor LED lamp bead group 5 is aslant welded on said circuit board 7, and the incline angle between the multicolor lamp beads and the circuit board is within the range of 10 to 30°.

Said rear reflection and diffusion panel 5 is closely attached to the non-copper face of said circuit board 7, the surface of the Said rear reflection and diffusion panel 5 with protuberances thereon is away from circuit board 7, and centers of said rear reflection and diffusion panel 5 and said circuit board 7 are overlapped. Said circuit board 7 is closely attached to the inner surface of concave disk 8, and the copper coated surface faces toward the inner bottom surface of concave disk 8; the preferred distance between said rear reflection and diffusion panel 5 and said grating panel 2 is within the range of 10 mm to 15 mm.

Therefore, when solar spectrum type LED eye-protection flat lamp of the present invention works, said multicolor LED lamp bead group 6 around the border emits light to front grating panel 2 and front diffusion panel 1. The white light emitted from the white LED lamp beads disposed on outer row on the periphery of circuit board 7, and the complement color light emitted from the warm white light LED, red light LED, orange light LED, yellow light LED and green light LED lamp beads disposed on the inner row on the periphery of circuit board 7, can be diffracted by the grating panel and scattered by the diffusion panel and emitted uniformly from the front of said flat lamp, whereby the emission spectrum of the flat lamp approximates to the solar visible spectrum. The stray light, diffused to said rear reflection and diffusion panel 5, is reflected to the front panels by said reflection and diffusion panel 5. Other stray light, diffused to the border, is reflected to the front and rear panels by said annular reflector.

In the preferred embodiment, the angle between said multicolor LED lamp bead group 6 and circuit board 7 is designed according to the size of the flat lamp (namely, the illuminance area), and the angle can be varied according to different sizes of the flat lamp in order to reach a uniform illuminance on front diffusion panel 1.

The preferred thickness of the flat illuminant of this solar spectrum type LED eye-protection flat lamp is within the range of 15 to 20 mm, and the preferred diameter is within the range of 205 to 305 mm.

This invention is not limited to the above mentioned embodiments and figures, every modification made by one with ordinary skill in the art should be seen as the coverage of this invention.

We claim:

1. A solar spectrum type LED eye-protection flat lamp, consisting essentially of:

a front grating plate;

a front diffusion plate;

a shading reflection ring;

a circuit board;

a rear reflection and diffusion plate;

a plurality of LEDs with different colors installed on the circuit board;

an annular reflector between the shading reflection ring and the rear reflection and diffusion plate;

wherein the front grating plate is arranged on a concave disk on a light-emitting side of the LED eye-protection flat lamp, wherein the front diffusion plate is arranged in front of the front grating plate;

wherein the rear reflection and diffusion plate is closely attached to the circuit board, and arranged on the concave disk at the backside of the LED eye-protection flat lamp, wherein the rear reflection and diffusion plate is arranged in front of the circuit board;

wherein a distance is reserved between the front grating plate and the rear reflection and diffusion plate to form a gap;

wherein the plurality of LEDs are arranged around the circuit board and located in the gap;

wherein the plurality of LEDs include at least one white light LED, at least one warm white light LED, at least one red light LED, at least one orange light LED, at least one yellow light LED, and at least one green light LED, wherein the plurality of LEDs are arranged in a two-row structure, the white light LED is disposed on an outer row on a periphery of the circuit board, and the warm white light LED, the red light LED, the orange light LED, the yellow light LED, and the green light LED are disposed on an inner row, wherein the circuit board is coated with copper, and the copper is used to dissipate heat for the plurality of LEDs.

2. The solar spectrum type LED eye-protection flat lamp of claim 1, wherein the rear reflection and diffusion plate includes a plurality of irregular protuberances on a reflecting surface.

3. A solar spectrum type LED eye-protection flat lamp, consisting essentially of:

a front grating plate;

a front diffusion plate;

a shading reflection ring;

a circuit board;

a rear reflection and diffusion plate;

a plurality of LEDs with different colors installed on the circuit board;

an annular reflector between the shading reflection ring and the rear reflection and diffusion plate;

wherein the front grating plate is arranged on a concave disk on a light-emitting side of the LED eye-protection flat lamp, wherein the front diffusion plate is arranged in front of the front grating plate;

wherein the rear reflection and diffusion plate is closely attached to the circuit board, and arranged on the concave disk at the backside of the LED eye-protection flat lamp, wherein the rear reflection and diffusion plate is arranged in front of the circuit board;

wherein a distance is reserved between the front grating plate and the rear reflection and diffusion plate to form a gap;

wherein the plurality of LEDs are arranged around the circuit board and located in the gap;

wherein the plurality of LEDs include at least one white light LED, at least one warm white light LED, at least one red light LED, at least one orange light LED, at least one yellow light LED, and at least one green light LED, wherein the plurality of LEDs are arranged in a two-row structure, the white light LED is disposed on an outer row on a periphery of the circuit board, and the warm white light LED, the red light LED, the orange light LED, the yellow light LED, and the green light LED are disposed on an inner row, wherein the circuit board is coated with copper, and the copper is used to dissipate heats for the plurality of LEDs, wherein the rear reflection and diffusion plate includes a plurality of irregular protuberances on a reflecting surface, wherein the front diffusion plate has a thickness of 1-2 mm, and a diameter of 200-300 mm, wherein the front grating plate is a polymer grating film having a thickness of 0.1-0.3 mm, wherein a diameter of the shading reflection ring is the same as a diameter of the front grating plate, wherein a diameter of the annular reflector is smaller than a diameter of the front diffusion plate, a width of the annular reflector is 10-15 mm, wherein a diameter of the rear reflection and diffusion plate is 20 mm less than the diameter of the front diffusion plate, wherein a height of the protuberances is 0.5-1.5 mm, wherein a thickness of the circuit board is 1.5-2 mm.

* * * * *